United States Patent [19]

Berger

[11] 3,955,063

[45] May 4, 1976

[54] WARMED SHIELD TO DIRECT STRIKES OF SNAKES

[76] Inventor: Raymond D. Berger, 1504-40th Ave. Court, Rock Island, Ill. 61201

[22] Filed: Feb. 10, 1975

[21] Appl. No.: 548,884

[52] U.S. Cl. ..... 219/211; 219/527; 219/549

[51] Int. Cl.[2] ..... H05B 1/00

[58] Field of Search ..... 219/211, 527–529, 219/535, 549; 128/379, 384

[56] References Cited

UNITED STATES PATENTS

| | | | |
|---|---|---|---|
| 2,590,212 | 3/1952 | Samuels | 219/527 UX |
| 2,617,916 | 11/1952 | Neidnig | 219/527 |
| 3,130,289 | 4/1964 | Katzman et al. | 219/528 X |
| 3,470,350 | 9/1969 | Lewis | 219/527 X |
| 3,748,436 | 7/1973 | Cossaboom | 219/527 X |

*Primary Examiner*—C. L. Albritton
*Attorney, Agent, or Firm*—Glenn H. Antrim

[57] ABSTRACT

A leg band comprises a shield encircled by an electrical heating element. Since venomous snakes strike at warm bodies, their strikes are directed to the impervious shield.

2 Claims, 4 Drawing Figures

WARMED SHIELD TO DIRECT STRIKES OF SNAKES

BACKGROUND OF THE INVENTION

This invention relates to protective clothing for guarding against bites from venomous snakes and particularly to warmed shields for directing the strikes of venomous snakes to protected positions.

Conventionally, in locations where venomous snakes are prevalent, leggings of thick leather or other materials impervious to the fangs of venomous snakes are worn for protection. If the leggings extend only to the knees of the wearer, in certain circumstances the upper portions of the legs of the wearer may be within striking distance of snakes. Since the upper portions of the legs are not heavily covered, snakes will tend to strike these portions that appear warmer.

SUMMARY OF THE INVENTION

A protective shield according to the present invention is warmed electrically to direct the strike of venomous snakes to an area protected by the shield. A few families of snakes have heat receptors that enable them to locate accurately nearby warmblooded animals on which they prey, so that they can strike very accurately to paralyze the animals. The heat receptors are in spaced cavities so that they function somewhat at infrared frequencies as eyes function at light frequencies to provide a sense of direction. One of the families having heat receptors is the well-known poisonous family of pit vipers that include the rattle snake, the water moccasin, and the copperhead.

Since the poisonous snakes strike at warm bodies, they tend to strike above the leggings because a person's skin there is likely to be covered with less material and tend to appear warmer than the area covered by the leggings. A warm, impervious band of the present invention lures snakes to strike protected areas to prevent strikes in unprotected areas. For example, the band may be placed about the upper portion of a legging to induce snakes to strike in the area protected by both the band and the legging other than to strike above the legging. The warmed band comprises a band of impervious material, such as flexible metal, and an electrical heating element surrounding the outside surface of the band.

DESCRIPTION OF THE PREFERRED EMBODIMENT

Figure 1:
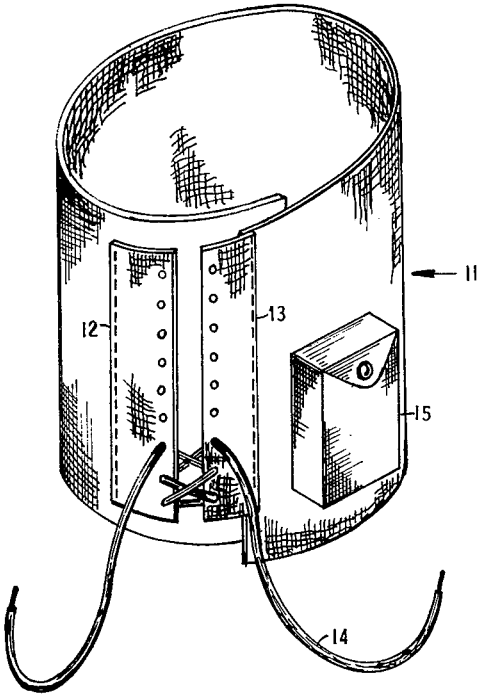
FIG. 1 is a perspective view of the band of this invention.

The shield 11 of FIG. 1 is in the form of a band overlapped to provide a cylindrical shield that can be applied to a person's leg. For fastening, a flap 12 is placed at a short distance from one end of the band, and a flap 13 is placed on the opposite end. The flaps have opposite holes to facilitate being laced together in a usual manner by a lace 14. A pocket 15 having a snap cover contains electric cells or a battery 16 shown schematically in FIG. 3.

Figure 2:
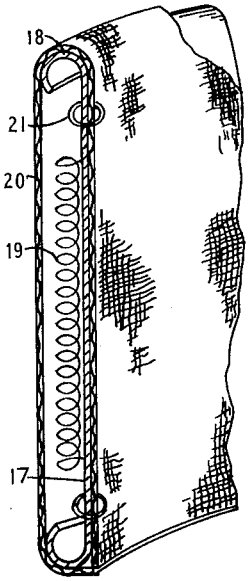
FIG. 2 is a fragmentary view to show a cross section of the band.
Figure 3:
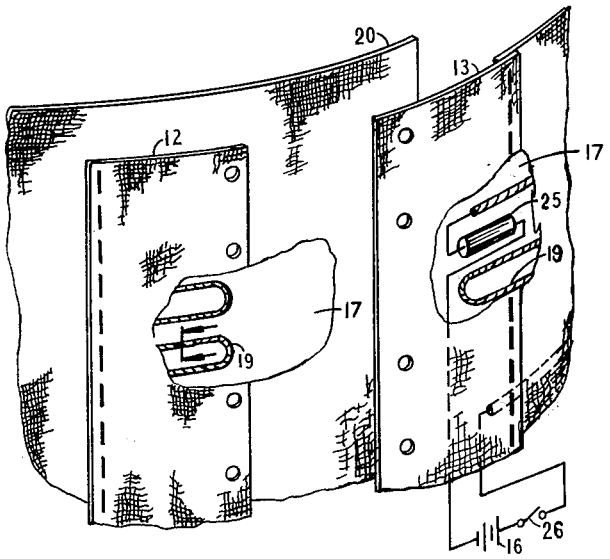
FIG. 3 shows an upper part of the overlapping portions of the band with cutaways to show the heating element and its circuit.

In FIGS. 2 and 3, a band of shielding material 17 may be a thin, flexible plate of hard material such as tempered metal or closely woven strips of hard material. Preferably, the upper and lower edges may have rolled or thicker portions 18. A heating element 19, shown diagrammatically in FIG. 2 and in detail in FIG. 3, encircles the central portion of the shield 17. The heating element 19 can extend nearly to the edges of the impervious shield 17, but when the strikes of snakes are to e confined strictly to the shield 17, a space ought to be left between the heater 19 and the edges of the shield to provide a margin of safety in the event strikes might not hit accurately the warm portion of the shield 17.

A convenient way to position the heater 19 with respect to the shield 17 and to provide means for attaching the shield to the user is by the use of a fabric cover 20. The cover 20 extends around the rolled edges 18 of the shield 17 to cover the shield completely, and the flaps 12 and 13 can be sewed to the outer portion of the cover 20. Where required, ties 21 can be placed through small holes in the shield 17, and similar ties can also be used to attach the heating element 19 to the cover 20.

Figure 4:
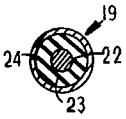
FIG. 4 is a cross-sectional view of the armored wire of the heating element of FIG. 3.

In FIG. 3, the heating element 19 runs back and forth circumferentially to cover a desired area of the shield 17 in somewhat the same way as the heating elements are positioned in usual heating pads. The heating element 19 comprises a resistance wire 22 surrounded by an insulating cover 23, and preferably the insulating cover 23 is covered by a hard armor 24 as shown in FIG. 4 to prevent damage to the insulating cover 23 and the resistance wire 22. The flap 13 is shown sewed to the cover 20 at one end of the shield 17, and the heating element 19 extends almost to this end of the shield. The other end of the shield 17 extends beyond the heating element 19, and the flap 12 is sewed at a sufficient distance from the end of the shield 17 to provide overlapping ends of the shield when the flaps 12 and 13 are laced together. A complete cylinder is formed to protect the wearer, and the shield 17 reflects heat from the heating element 19 outwardly to direct strikes of the snakes.

One terminal of the battery 16 is connected through a thermostatic switch 25 to one end of the resistance wire 22 of the heating element 19, and the other end of the resistance wire is connected through an off-on switch 26 to the other terminal of the battery 16. The thermostatic switch 25 is positioned adjacent to the heating element 19 in a conventional manner as in a heating pad for controlling the temperature of the heating element 19.

I claim:

1. An electrically warmed shield to be worn by a person for directing the strikes of venomous snakes comprising:

a flexible hard band, means for securing said band about the limb of a person to form thereabout a closed cylindrical heat-reflecting wall impervious to the fangs of snakes, an electrical heating element, and means for securing said heating element to that surface of said band adapted to face outwardly from a limb to which said band is to be secured, said heating element adapted to be heated for radiating directly therefrom and by reflection from said band in a direction outwardly from a limb to which the band is attached sufficient heat to direct strikes of venomous snakes to said band and thereby to protect the person wearing said warmed shield.

2. A warmed shield as claimed in claim 1 wherein said electrical heating element encircles said band, the edges of said band extending a substantial distance beyond any portion of said heating element.

* * * * *